US008783784B2

(12) United States Patent
Graham

(10) Patent No.: US 8,783,784 B2
(45) Date of Patent: Jul. 22, 2014

(54) MATERIAL AND EQUIPMENT RECOVERY SYSTEM

(75) Inventor: Robert Wayne Graham, Whitman, VA (US)

(73) Assignee: Logan Hydraulics Co., Logan, WV (US)

( * ) Notice: Subject to any disclaimer, the term of this patent is extended or adjusted under 35 U.S.C. 154(b) by 0 days.

(21) Appl. No.: 13/540,877

(22) Filed: Jul. 3, 2012

(65) Prior Publication Data

US 2013/0049435 A1 Feb. 28, 2013

Related U.S. Application Data

(60) Provisional application No. 61/528,200, filed on Aug. 27, 2011.

(51) Int. Cl.
*E21F 13/00* (2006.01)
*E21C 35/24* (2006.01)

(52) U.S. Cl.
CPC ..... *E21F 13/006* (2013.01); *E21C 35/24* (2013.01)
USPC ..... 299/30; 299/1.05

(58) Field of Classification Search
USPC ..... 299/1.05, 1.9, 30
See application file for complete search history.

(56) References Cited

U.S. PATENT DOCUMENTS 2,826,402 A 5/1958 Alspaugh et al.
4,192,551 A 3/1980 Weimer et al.
4,281,876 A 8/1981 Lansberry
4,323,280 A 4/1982 Lansberry et al.
4,708,395 A 11/1987 Petry et al.
5,003,236 A 3/1991 Harless
5,112,111 A * 5/1992 Addington et al. ..... 299/18
5,161,857 A * 11/1992 Mayercheck et al. ..... 299/30
5,364,171 A 11/1994 Addington et al.
5,609,397 A 3/1997 Marshall et al.
5,682,312 A 10/1997 Rocke
5,709,433 A 1/1998 Christopher et al.
5,879,057 A * 3/1999 Schwoebel et al. ..... 299/17
6,109,699 A 8/2000 Mraz
6,270,163 B1 8/2001 Mullet et al.
6,336,684 B1 1/2002 Turner
6,633,800 B1 10/2003 Ward et al.
6,652,035 B2 * 11/2003 Chisholm ..... 299/18

(Continued)

*Primary Examiner* — David Bagnell
*Assistant Examiner* — Michael Goodwin
(74) *Attorney, Agent, or Firm* — Robert R. Waters; Brian W. Foxworthy; Waters Law Group, PLLC

(57) ABSTRACT

A material and equipment recovery system for high risk environments has a recovery vehicle and surface control station, and a communication link between them, which may be an Ethernet link. The recovery vehicle has an operable recovery implement suitable to its particular application. The surface control station has an operator station from which an operator can operate the recovery vehicle remotely. Cameras on the recovery vehicle provide images for an operator to maneuver the recovery vehicle and monitor systems on the recovery vehicle. The surface control station also has a winch and recovery cable that attaches to the recovery vehicle to retrieve it should it become disabled. An optical alignment device on the surface control station allows alignment of the surface control station to keep the retrieval cable effective. The recovery vehicle and control station have hitch elements and the recovery vehicle can reposition the control station at a site.

22 Claims, 6 Drawing Sheets

(56) References Cited

U.S. PATENT DOCUMENTS

| | | | | |
|---|---|---|---|---|
| 7,499,804 | B2 | 3/2009 | Svendsen et al. | |
| 7,594,702 | B2 | 9/2009 | Lowery | |
| 8,090,491 | B2 | 1/2012 | Barfoot et al. | |
| 2002/0093565 | A1* | 7/2002 | Watkins | 348/148 |
| 2007/0096538 | A1* | 5/2007 | Niemi et al. | 299/1.05 |
| 2010/0259091 | A1 | 10/2010 | Hackelboerger et al. | |
| 2010/0308639 | A1* | 12/2010 | Cushman | 299/18 |
| 2012/0035798 | A1 | 2/2012 | Barfoot et al. | |

* cited by examiner

MATERIAL AND EQUIPMENT RECOVERY SYSTEM

RELATED APPLICATIONS

This application claims priority from U.S. Provisional Application No. 61/528,200, filed on Aug. 27, 2011. The entire disclosure contained in U.S. Provisional Application 61/528,200, including the attachments thereto, is incorporated herein by reference.

FIELD OF INVENTION

The present application is generally related to material and equipment recovery. More specifically, the present application is related to material and equipment recovery in a high risk environment with an unmanned vehicle.

BACKGROUND OF THE INVENTION

One example of an application for the apparatus of the present invention is highwall mining. During the past forty years, highwall mining has proven to be an efficient method of mining coal, or other sought after material, that would not be mined by other methods. Highwall mining is a form of mining frequently used to supplement strip mining.

Strip mining is used when the sought after material deposits, such as coal, occur relatively close to the surface. In strip mining, the top several layers of earth over a coal deposit are removed along with the coal deposit to gain access to the coal deposit. The material of the covering layers is called overburden. When the coal to overburden ratio falls below a certain ratio, the process becomes unprofitable and strip mining ceases to be the economically preferred technique at that location. At that point in time, the strip mining has produced a large pit with seams of coal extending from the surface of the walls of the pit back into the earth. Highwall mining is a type of mining used to extract, or mine, the coal in the seams terminating at the walls of the pit.

In highwall mining, a highwall mining machine is located on the pit floor in alignment with a coal seam and a remote operated cutter module is forced into the coal seam. The cutter cuts a series of parallel rectangular cuts back into the seam up to 1,000 feet from the face of the wall. This is considered too dangerous for the insertion of any personnel and the cutter modules are directed and operated remotely. The coal mined by the cutter module is transported from the cutter module to the surface area by augers or conveyor belt systems.

Typically, the cuts and the entries to the cuts are rectangular. The width of the entry to a cut is dependent on the type of cutter module used, and the width may vary from 9½ feet to 12 feet. The height of the entry is more dependent on the coal seam's thickness, and the height may vary from 28 inches to more than 15 ft.

Today's highwall miners produce an average of 100,000 tons of coal per month per highwall miner. Highwall miners and their supporting augers and conveyors are highly automated. Due to the cutter module design as well as other factors in the mining process, some percentage of the coal mined by the highwall miner ends up as spillage and is not recovered. The percentage of spillage is estimated, conservatively, to be between eight and fifteen percent of the coal that is cut during the mining cycle. This coal remains in the cut after the cutter module and the support augers or conveyors have been extracted.

On occasions, components from the cutter modules become detached and are lost during the mining process. At the present time, there is not a practical way of recovering these components, and the cutter module cannot continue to operate with the loose component in the cut. When this happens, the only option for the operator is to withdraw the mining equipment from that particular cut, or hole, and proceed to the next setup. The component from the cutter module is lost, as well as any recoverable coal remaining in the seam past the lost component.

At present time, it is estimated that there are more than one hundred highwall miners being operated in the coal industry, each one producing multiple cuts during an operating day. They all have the same problems to varying degrees. A need exists for a system capable of recovering mined coal that is left behind in highwall mining cuts as well as lost components. Substantial monetary gains may be achieved by recovering the coal and lost components. Additionally, once a component is recovered and the cut cleared, a highwall miner can return to the cut to further exploit the seams at that location for further monetary benefit. For monetary purposes the system must be efficient, reliable, and not labor intensive. For safety purposes, the system must not require personnel to be exposed at or near the highwall of the pit. The system should be able to work in close proximity with high wall miners.

RELEVANT ART

U.S. Pat. No. 6,633,800 by Ward is for a "Remote control system." An apparatus and method for a control unit allows for autonomous, manual and tele-operation of mining vehicles. The control unit has a robust system design to withstand the harsh environment of underground mines. The control unit allows a tele-operator, in a remote tele-operator station, to use image and operational data, joysticks and foot pedals to remotely control the mining vehicle. In another aspect, the control unit provides safety features such as supervising its operation for operational errors and providing status, warning and error information to the tele-operator station.

U.S. Pat. No. 6,109,699 by Mraz is for a "Tow Line Equipped Remote Mining Machine and Method." Mraz discloses a method and apparatus for advancing cables and hoses to a remotely operated mining machine and retrieval of the machine in case of accident. The apparatus supports remote haulage of material in a self-propelled vehicle guided within a mine opening, so as to avoid interference with cables and hoses and the walls of the mine opening.

U.S. Pat. No. 4,708,395 by Petry, et al. is for a "Remotely sensing of excavation cavity during mining." Petry discloses a method and apparatus for hydraulically mining a location using a hydraulic monitor which has a horizontal and vertical positionable control apparatus. The hydraulic monitor is connected to a source of high pressure water. Distance and direction measuring equipment are mounted on the monitor and controlled in a manner to scan the location. The output from the distance and direction measuring equipment is inputted to a computer and a visual video display monitor. The computer converts the information from the distance and direction measuring equipment to a visual representation of the cavity being mined. The hydraulic monitor includes a means for diverting the high velocity jet during the distance measuring period so that the water pressure is not varied in the high pressure pipe, and the mined material is continuously washed toward the collection apparatus during the measuring period. All hydraulic monitor functions are controlled from the remote operator location.

U.S. Pat. No. 4,192,551 by Weimer, et al. is for "Remote control system for mining machines." Weimer discloses a system that controls all miner hydraulic and electrical functions from a hand held miner remote control pendant. Pendant control devices provide on/off control signals to interfaces with miner drive and pump controllers, as well as a group of +−6 VDC differential proportional and on/off control signals to respective electronic valve drivers. Valve driver outputs are fed to respective force motors on pilot stage valves which control each hydraulic function. Each valve driver output is modified by offset and dither signals to overcome power stage valve dead band and frictional characteristics. Pilot stage valves have an internal feedback sleeve co-acting with a pilot valve spool in a hydraulic servo circuit. Pilot stage valves operate in a pilot oil system which may be isolated from power oil systems.

SUMMARY

The various embodiments of the present invention are made primarily of two units. These units are a recovery machine that is capable of traveling into highwall mine cuts, or holes, and a remote surface control station for the recovery machine. Depending on the particular application, the recovery machine may be equipped to recover a component lost in a highwall cut or material spillage such as coal left in a highwall cut. The remote surface control station is located a safe distance away from the highwall and sufficiently aligned with the cut for the operation. In at least one embodiment, a communication cable connects between the recovery machine and the surface control station to form a communication link and allow an operator located within the control station to operate the recovery vehicle. The communication link formed with the communication cable may be an Ethernet communication link.

The surface control station includes many components to allow the system a high level of independent operation. As a foundation, all of the other components of the surface control station are located on a wheeled chassis. In some embodiments, this wheeled chassis may be a trailer. This wheeled chassis is highway ready with all required safety features as well as a suitable hitch when necessary, such as a fifth wheel type hitch, for connecting to a highway vehicle. The wheeled chassis also has stabilizing capabilities, such as outriggers, for operating at mine sites. Among the components that may be located on the wheeled chassis are: an operator station with controls and monitoring screens; an electrical generator; a hydraulic power unit; a battery charger; a transformer; circuit breakers; an air compressor; a crane; a battery charging station; a retrieval winch; an electric welder; and an optical alignment device, such as a laser alignment device. A cable on the retrieval winch attaches to the recovery vehicle to retrieve it should the vehicle become disabled, and the optical alignment device provides an efficient gauge for aligning the surface control station with a respective highwall cut to keep the retrieval winch and cable effective.

In at least one embodiment of the system, the recovery vehicle uses electricity as its basic source of power. This electricity may originate at an onboard battery, or bank of batteries, or the electricity may be provided by an electrical power cable connected between the recovery machine and the surface control station. Various converters can convert the electricity to the appropriate form for the various systems and needs on the recovery vehicle.

A hydraulic pump driven by an electric pump motor provides hydraulic power for the various motive elements of the recovery vehicle, such as hydraulic cylinders and motors, while a programmable controller operates a hydraulic manifold to convert signals from the surface control stations to actions of the recovery vehicle. For control purposes, a signal cable connects the recovery vehicle to the surface control station. A reel on the recovery vehicle carries the signal cable and turns to take up and feed out the cable as the recovery vehicle operates. On some embodiments, a moving guide would wind the cable on the reel in a balanced or level manner. Lights and cameras mounted on the recovery vehicle provide information for an operator on screens at the operator station. The lights and cameras provide a forward view, a rear view, and a view of vehicle status gauges on the recovery vehicle. These vehicle status gauges may include: methane detector; a hydraulic system pressure gauge; and a battery power level gauge, among others.

Additionally, the recovery vehicle will have an operable recovery implement capable of remote operation by an operator, and at least one embodiment of the recovery vehicle will have a towing feature. This towing feature may be a hitch element complimentary to the hitch on the surface control station or it may be a feature allowing the easy attachment of a hitch element complimentary to the hitch on the surface control station. The hitch element allows the recovery vehicle to tow the surface control station to a different location at the mine site. This provides total autonomy for the recovery system at the mine site. The particular recovery implement on the recovery vehicle will depend on the particular application. For coal or material recovery, the recovery implement is a scoop. For equipment recovery, the recovery implement may be a grapple, manipulator, cutter, or a combination of these.

BRIEF DESCRIPTION OF THE DRAWINGS

Additional utility and features of the invention will become more fully apparent to those skilled in the art by reference to the following drawings, which illustrate some of the primary features of preferred embodiments.

DESCRIPTION OF THE EMBODIMENT(S)

Figure 1:
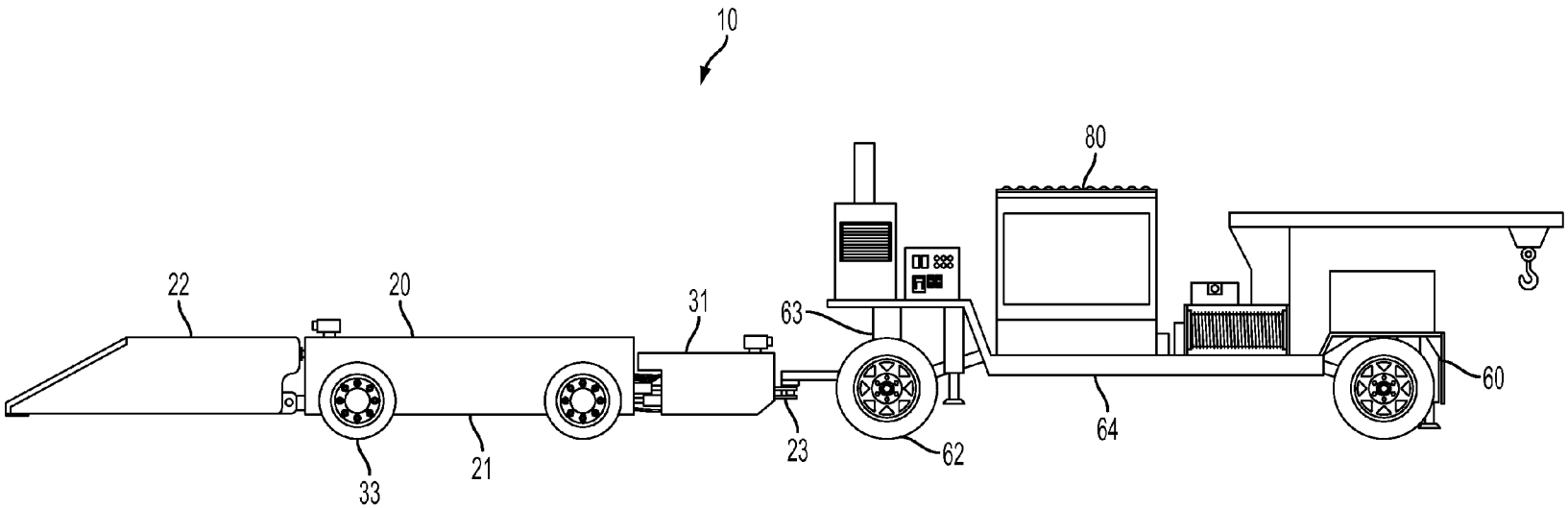
FIG. 1 is a side view of an embodiment of the material and equipment recovery system with the recovery vehicle hitched to the surface control station.

FIG. 1 is a perspective view of an embodiment of recovery system 10. In FIG. 1, recovery vehicle 20 is hitched to surface control station 60. In this embodiment, recovery vehicle 20 can hitch to surface control station 60 to move about a mine site. The ability of recovery system 10 to reposition itself about a mine site gives the system complete operational autonomy. In FIG. 1, recovery vehicle 20 tows fifth wheel dolly 62 and fifth wheel hitch 63 on surface control station 60 joins to fifth wheel dolly 62. Later figures provide more detail for recovery vehicle 20 and surface control station 60.

Figure 2:
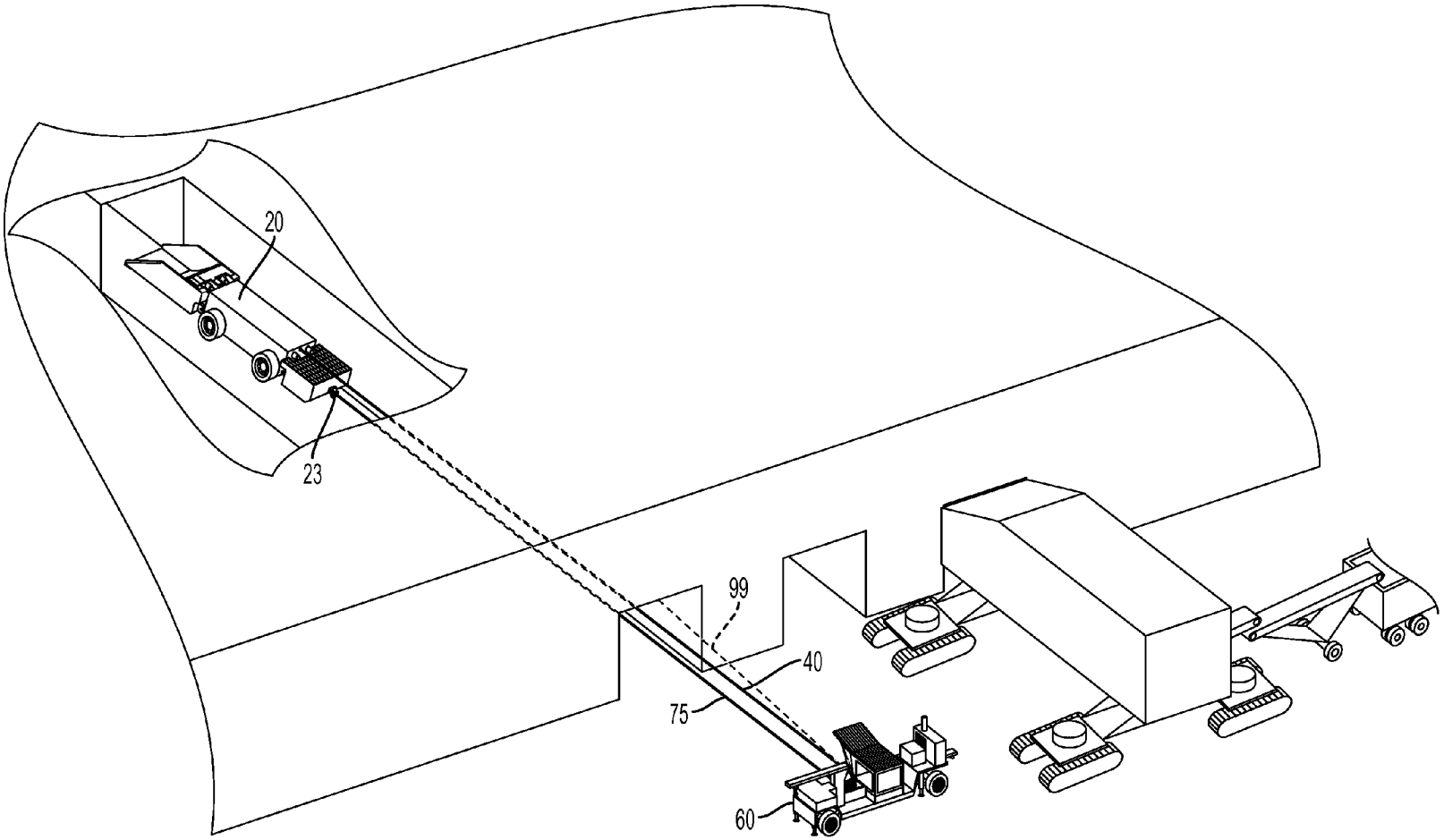
FIG. 2 shows the recovery system in location at a mine.

FIG. 2 shows recovery system 10 in location at a mine. Surface control station 60 is aligned with a cut previously made by a highwall miner. Recovery vehicle 20 is located within the cut and is operated from surface control station 60. Data cable 40 extends from surface control station 60 to recovery vehicle 20 to transmit control signals from surface control station 60 to recovery vehicle 20. A cable reel on recovery vehicle 20 takes up and feeds out data cable 40 as recovery vehicle 20 moves back and forth. Retrieval cable 75 extends from surface control station 60 to recovery vehicle 20. Retrieval cable 75 is wound upon a winch on surface control station 60 and attaches to retrieval hitch 23 on recovery vehicle 20.

Figure 3:
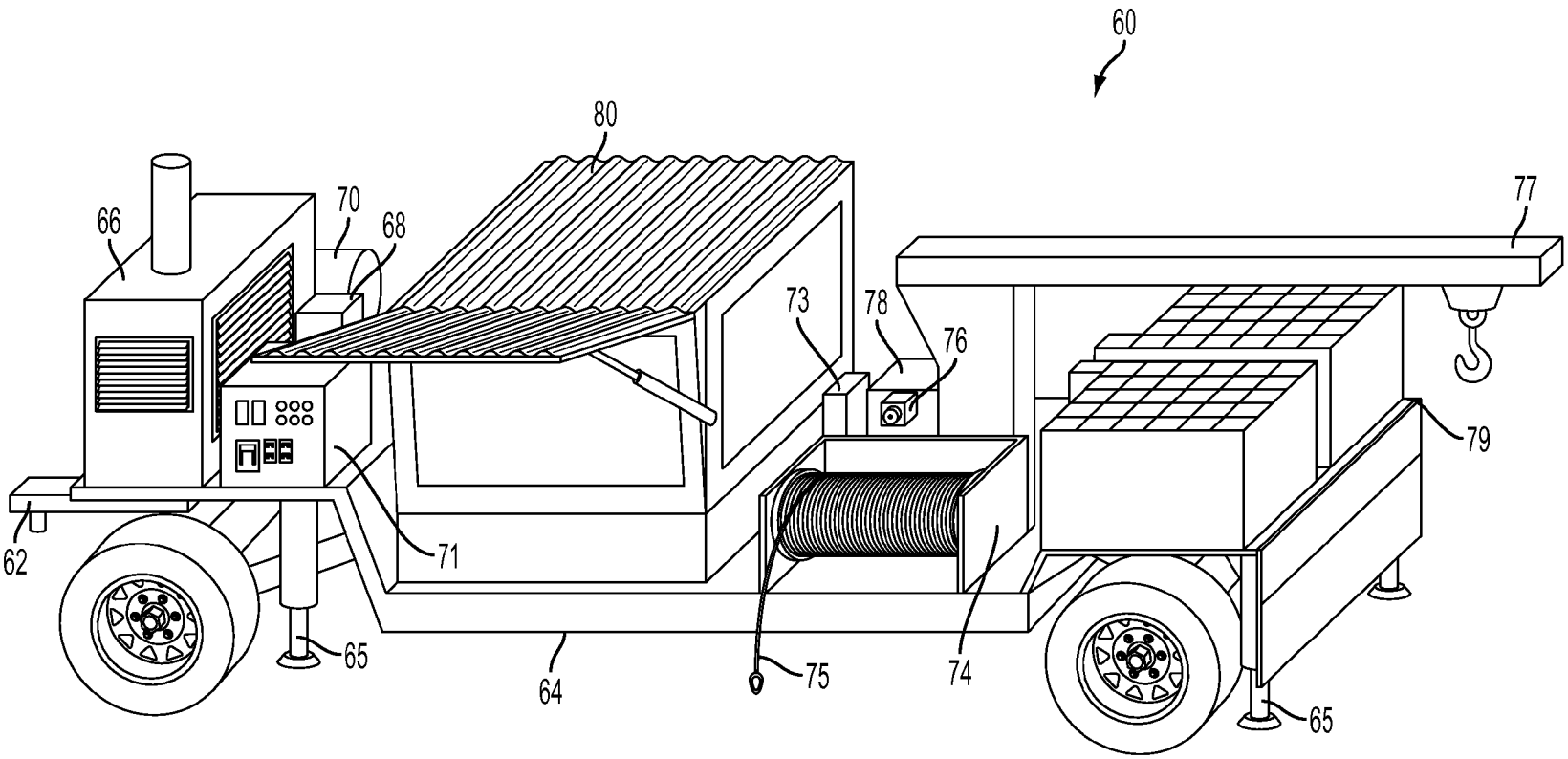
FIG. 3 is a side perspective view of the surface control station portion of the recovery system.

FIG. 3 is a side perspective view of surface control station 60 portion of recovery system 10. The foundation of surface control station 60 is a wheeled chassis. In the embodiment of FIG. 3, the wheeled chassis is trailer 64. Trailer 64 is a road ready trailer and has all that is needed to be used on the highway. Its rear has all the appropriate lights, and its tires and axels are standard for highway travel. Trailer 64 also has a hitch 63 (see FIG. 1), which can couple with appropriate towing vehicles such as trucks, semi-tractors. Depending on the particular application hitch 63 may take different forms, for example a fifth wheel hitch. Hitch 63 may also be used to move trailer 64 about the mine site. This may be done with the towing vehicle as well as recovery vehicle 20.

Once trailer 64 is located at the desired position at a mine site, trailer 64 has outriggers 65 to level and stabilize surface control station 60. Outriggers 65 are hydraulically powered and hydraulic power is provided by elements mounted on trailer 64. Outriggers 65 can be independently operated to obtain as close an approximation to true level as necessary. For example, in some embodiments, the limiting element may be retrieving winch 74 and retrieval cable 75. Retrieval cable 75 must be sufficiently strong, i.e. thick, therefore heavy, to pull a disabled recovery vehicle 20 from a cut. If retrieving winch 74 is fixed to the wheeled chassis of surface control station 60 it will mirror the tilt of the chassis. If retrieving winch 74 is sufficiently tilted from level, the weight of retrieval cable 75 will cause it to pile up at the low end of the spool of retrieving winch 74. With the substantial length required of retrieval cable 75, this would eventually lead retrieval cable 75 to run off of the spool. Independent operation of outriggers 65 provide finer adjustments for leveling surface control station 60, as indicated by a level bubble or other display.

Surface control station 60 carries its own power source. At the left end of trailer 64 in FIG. 3 generator 66 may be seen. Generator 66 can be any generator appropriate to the task. In at least one embodiment, generator 66 is a three-phase generator powered by a diesel engine. Such a generator is commercially available from several manufacturers.

Next to generator 66 on trailer 64 is step down transformer 68. Step down transformer 68 converts the power generated by generator 66 to a different form that can be used by other elements on trailer 64. For example, one embodiment of surface control station 60 may have a 480 volt three phase generator and step down transformer 68 may convert that to a 240-120 volt single phase power.

Behind power generator 66 in FIG. 3 is located hydraulic pump 70. Hydraulic pump 70 generates hydraulic power for other elements on trailer 64. Outriggers 65 are powered by hydraulic fluid pumped by hydraulic pump 70. Also, a jib crane 77, which will be discussed shortly, may be powered by hydraulic fluid from hydraulic pump 70. Other elements on surface control station 60 may also use hydraulic cylinders or motors as well.

Also next to power generator 66 is circuit breaker panel 71. Circuit breaker panel 71 carries the breakers and switches necessary to protect the various electrical systems of surface control station 60.

Operator station 80 is located to the left center of trailer 64. Operator station 80 is where an operator would be located as the recovery system is in operation. Among other things, operator station 80 would have controls to operate recovery vehicle 20. The controls operate as if the operator is actually on the vehicle and displays in the operator station allows the operator to see the progress of the recovery vehicle in its environments. A data cable lying between surface control station 60 and recovery vehicle 20 carries the digital data to be displayed on the display screens. In addition to a visual display of the environments of the recovery vehicle 20, a visual display in operator station 80 would show a camera view of a methane gauge monitor located on recovery vehicle 20. Operator station 80 may be furnished as necessary to be usable by an operator and may also have climate control such as air conditioning or heating.

Air compressor 73 located next to operator station 80 provides the compressed air needed for various applications. For example, trailer chassis 64 may very well have air brakes and it would be preferable that the brakes would be operable as trailer 64 is being moved about the mine site, for example by recovery vehicle 20. There are other uses for compressed air in an industrial environment. Many power tools are powered by compressed air and compressed air is frequently used to clean equipment by blowing off dust, dirt, grime etc., especially when it is preferred that water not be used for corrosion reasons.

Retrieving winch 74 is located to the center right of surface control station 60. Retrieving winch 74 has a cable 75, or wire rope, which when in use attaches to the back of recovery vehicle 20, when recovery vehicle 20 is being used within a mine cut. Retrieving winch may be either electrically powered or hydraulically powered. Mounted in close proximity to retrieving winch 74 is an optical alignment device. In the embodiment shown in FIG. 3, the optical alignment device is a laser alignment device 76. Laser alignment device 76 is used to provide quick guidance in the positioning of surface control station 60 in front of a mine cut. The proper alignment of surface control station 60 with the cut is important to keep retrieving winch 74 effective in reeling in cable 75. If surface control station 60 is not properly aligned, the misalignment will cause retrieval cable 75 to pile up at one end of the spool of retrieving winch 74, similar to the problem of excessive deviation from level.

In some applications and situations, retrieving winch 74 may be sufficient to retrieve recovery vehicle 20. In some situations, however, the surface upon which surface control station 60 is located may be too slick to maintain surface control station 60 in place while cable 75 is repeatedly reeled in, let alone to retrieve recovery vehicle 20. When necessary, surface control vehicle 60 may be tied off to anchors in the ground. Also, heavy equipment may be brought in for retrieval of recovery vehicle 20. For example, a bulldozer may be brought in and tied off to cable 75 to extract recovery vehicle 20.

The right end of surface control station 60 is generally dedicated to battery charging and changing. Battery charger 78 is located behind retrieving winch 74. Battery charger 78 is rated and configured to charge batteries, or battery banks for recovery vehicle 20. At the right end of surface control station 60 is battery charging station 79. Battery station 79 is the location where batteries that are being charged sit. Jib crane 77 is located to the left of battery station 79. Jib crane 77 is used to move batteries on and off of surface control station 60 and also to load batteries onto recovery vehicle 20.

Figure 4:
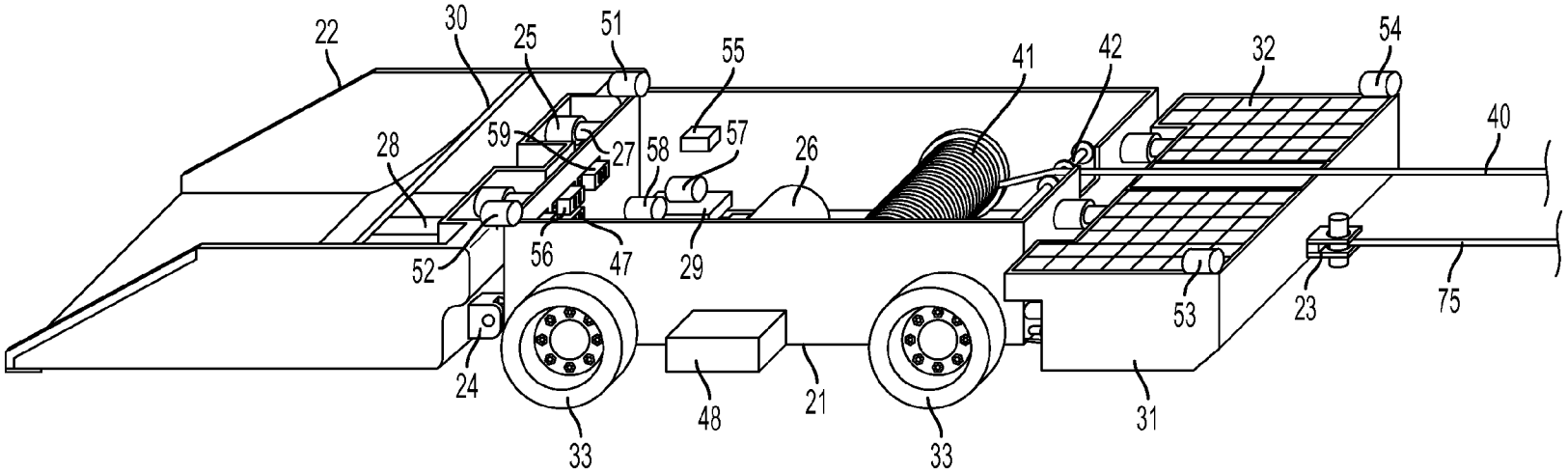
FIG. 4 is an elevated perspective view of the recovery vehicle portion of the recovery system.

FIG. 4 is an elevated perspective view of the recovery vehicle 20 portion of recovery system 10. In general, recovery vehicle 20 is built with a low profile to allow it to be used in cuts that are low. In the embodiment of recovery vehicle 20 shown in FIG. 4, recovery vehicle 20 is equipped to recover material such as coal. Therefore, the implement attached to the main body, or chassis, 21 of recovery vehicle 20 is a scoop 22. Scoop 22 has a low profile like the main body 21 of recovery vehicle 20. Scoop 22 is mounted to chassis, or main body, 21 of recovery vehicle at a lower pivot point 24. At an upper pivot point 25, actuator cylinders 27 connect between scoop 22 and body 21. Actuator cylinders 27 are hydraulically powered and hydraulic pump 26 located centrally in body 21 provides that power as well as hydraulic power needed by other elements. Ejector blade 30 within scoop 22 is powered by ejection cylinder 28 which extends ejection blade 30 out through the length of scoop 22 to discharge material from scoop 22. As with hydraulic actuators 27, ejection cylinder 28 is hydraulically powered.

At the right end of recovery vehicle 20, battery tray 31 is attached to body 21. Battery tray 31 is connected by a lower pivot to body 21 while battery tray actuators are connected at other pivots. The battery tray actuators raise and lower battery tray 31. Because this embodiment of recovery vehicle 20 has battery tray 31 at the rear of recovery vehicle 20, retrieval hitch 23 is located on battery tray 31. Batteries 32 in battery tray 31 are the source of power for recovery vehicle 20 in the embodiment shown in FIG. 4. In the embodiment shown in FIG. 4, the drive train of recovery vehicle 20 is powered ultimately by batteries 32. Hydraulic pump 26 is powered by batteries 32 and hydraulic pump 26 provides hydraulic power to actuators and motors in recovery vehicle 20. In the embodiment shown in FIG. 4, recovery vehicle 20 is propelled by wheels 33. Wheels 33 in turn are powered by hydraulic motors receiving their hydraulic power from hydraulic pump 26.

Centrally located in recovery vehicle 20 is cable reel 41. Cable reel 41 carries the data cable 40 over which control signals are received from surface control station 60 and is powered to reel in or feed out data cable 40 as recovery vehicle 20 transits. Data cable 40 extends over battery tray 31 and between battery banks 32. Guide 42 positioned to the right of cable reel 41 moves back and forth as data cable 40 is reeled in or fed out to keep data cable 40 wrapped in a uniform fashion on a cable reel 41. At the forward end (left end in FIG. 4) of the body 21, forward light 51 and forward camera 52 are mounted. Forward camera 52 provides a view to the front of recovery vehicle 20. This view, or image, is transmitted over data cable 40 back to surface control station 60 where it is displayed for an operator. At the rear end (right end in FIG. 4) of recovery vehicle 20, rear light 53 and rear camera 54 are mounted. Rear camera 54 provides a view to the back of recovery vehicle 20 so that an operator may see the view in back of recovery vehicle while it is being reversed. In the embodiment shown in FIG. 4, rear light 53 and rear camera 54 are mounted at the outer edge of battery tray 31.

Methane gauge 55 is mounted to body 21 of recovery vehicle 20. Gauge light 57 and gauge camera 58 are directed on gauge display 56 of methane gauge 55 to provide a real time view of measured methane levels to an operator in surface control station 60. Other gauges that might be monitored are gauges that show the status of systems on recovery vehicle 20, such as hydraulic pressure gauge 47 for the hydraulic system of the drive train, or battery power gauge 59 for batteries 32. All visual images from forward camera 52, rear camera 54, and gauge camera 58 are conducted via data cable 40. Cameras 52, 54, and 58, as well as any cameras used by other embodiments, may be any device capable of registering and transmitting an image.

Hydraulic valve manifold 29 is located next to hydraulic pump 26. Hydraulic valve manifold 29 is operated by programmable logic controller 43 located in control enclosure 48 located along the side of body 21. Hydraulic valve manifold 29 controls and directs hydraulic fluid to the appropriate sides of cylinders as well as drives the hydraulic motors for the wheels 33 of recovery vehicle 20 in the correct direction.

Figure 6:
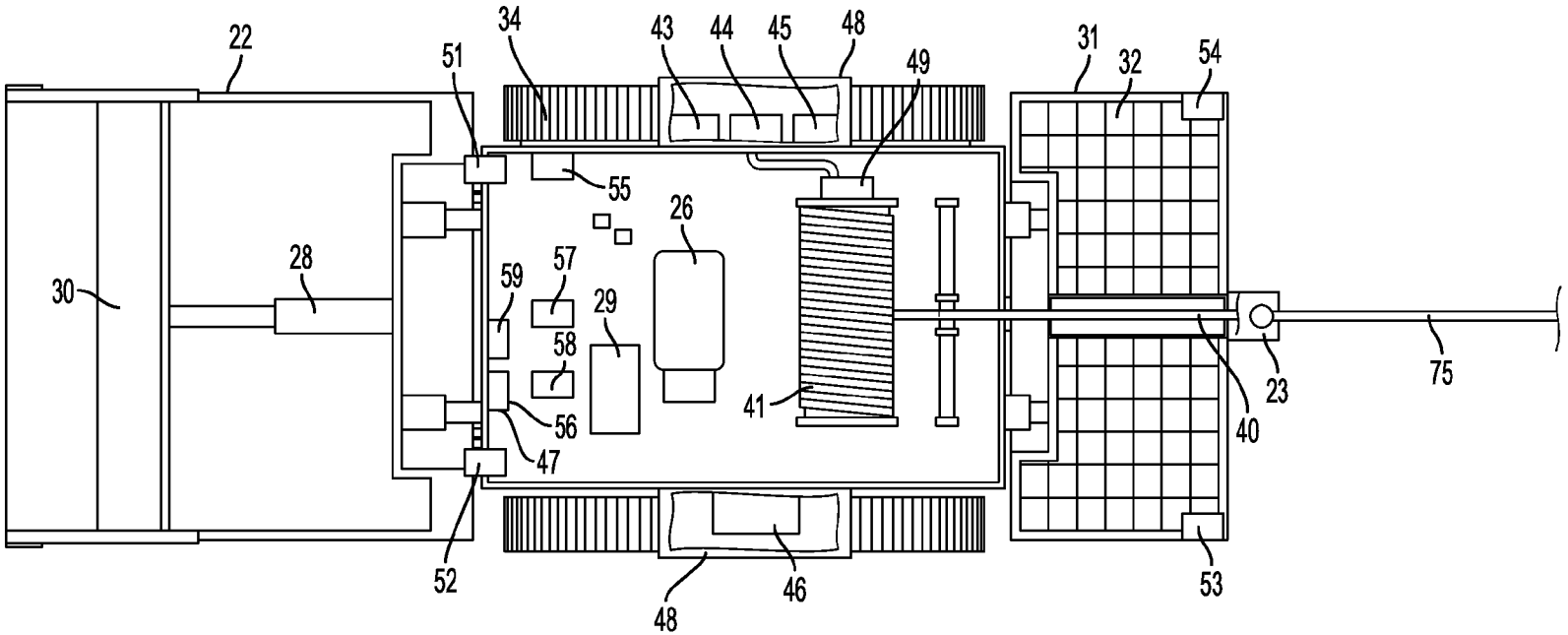
FIG. 6 is a top view of an embodiment of a recovery vehicle of the present invention.

FIG. 6 is a top view of an embodiment of a recovery vehicle 20 of the present invention. The hydraulic power train in the embodiment of FIG. 6 terminates in tracks 34. For some environments and applications, tracks 34 provide better traction.

In FIG. 6, enclosures 48 of recovery vehicle 20 are shown open. Several control and communication elements may be seen in enclosures 48. Ethernet extender 44 receives and amplifies signals from data cable 40. Slip ring 49 at cable reel 41 maintains electrical continuity with data cable 40 on cable reel 41 and transmits the signals to Ethernet extender 44. Controller 43 executes signals received from surface control station 60 via Ethernet extender 44 to operate hydraulic valve manifold 29. Constant voltage power supply 45 consistently provides the required voltage for the systems on recovery vehicle 20. Pump motor controller 46 controls hydraulic pump 26.

Figure 5:
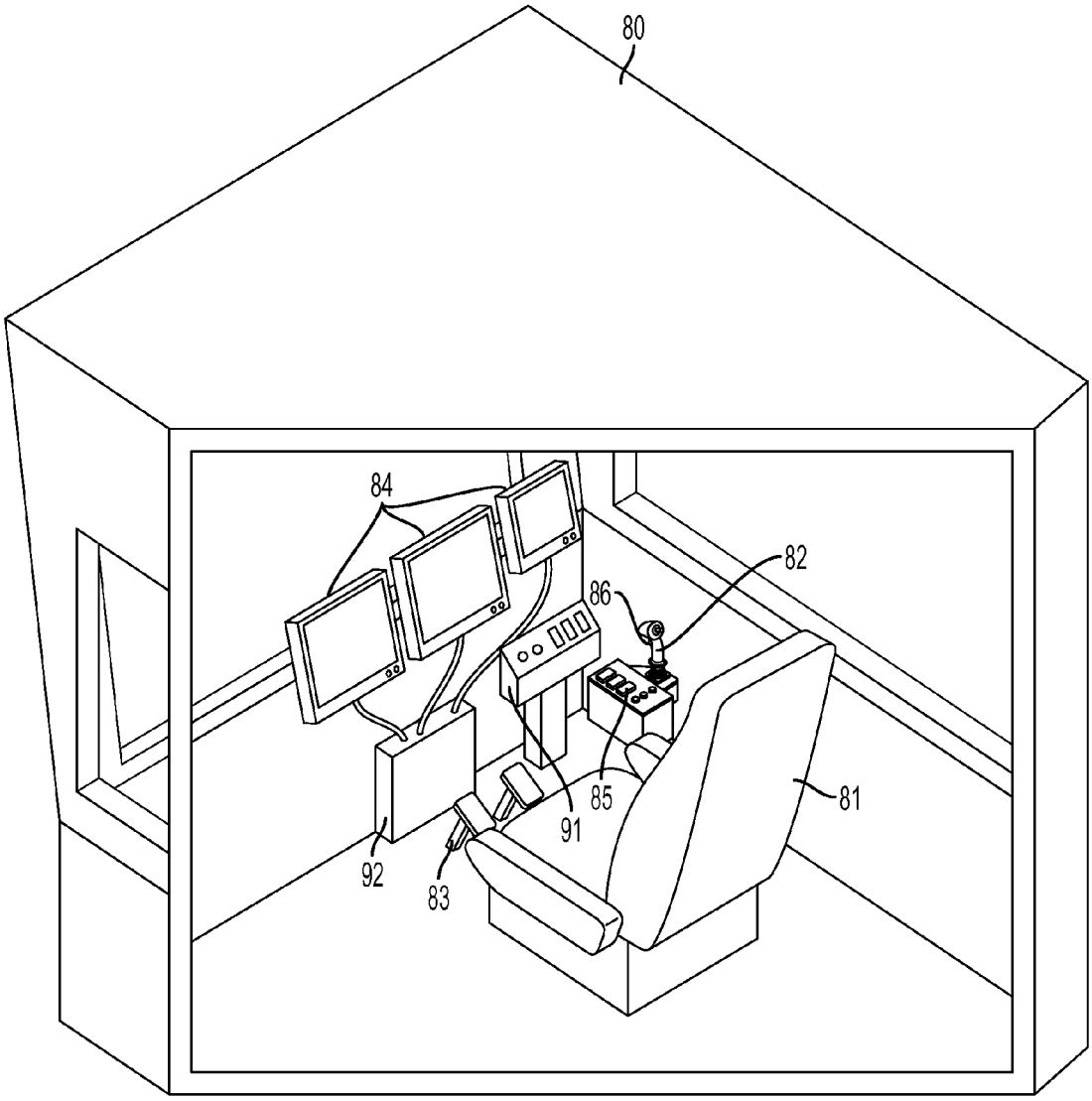
FIG. 5 is a sectional perspective view of an embodiment of an operator station of the present invention.

FIG. 5 is a sectional perspective view of an embodiment of an operator station 80 of surface control station 60. Operator station 80 provides a location from which an operator can operate material or equipment recovery system 10. Seat 81 in operator station 80 is positioned within reach of operator interface devices such as of joystick 82 and pedals 83 and facing video display screens 84. Seat 81 may swivel, raise, lower, etc. depending on the embodiment.

Video displays 84 display images from forward camera 52, rear camera 54, and gauge camera 58. In the embodiment shown in FIG. 5, operator station 80 has three video displays 84, or one per camera. However, other embodiments might use fewer displays and employ split screen displays, or provide operator buttons to switch between cameras.

In the embodiment shown in FIG. 5, operator station 80 utilizes only one joystick 82 which is fixed mounted apart from seat 81. Other embodiments of operator station 80 may use more than one joystick 82 to receive operator input and in some cases joystick 82 may be mounted to the arm of seat 81. Joystick 82 receives input by an operator moving joystick 82 forward and back and left and right or some angle between. These movements of joystick 82 translate to similar motions for recovery vehicle 20. For single joysticks 82, the system would be programmed to translate the input to control wheels 33 or tracks 34 on both sides of recovery vehicle 20. For systems employing two joysticks 82, each joystick 82 would control wheels 33 or tracks 34 on the corresponding side of recovery vehicle 20.

Buttons 85 or trigger 86 on, or near, joystick 82 provide other control signals such as for the operable recovery implement, such as scoop 22. For example, buttons 85 can generate control signals to raise or lower scoop 22 and to extend or retract ejection blade 30. Also, for embodiments employing an adjustable battery tray 31, buttons 85 could signal to raised and lower battery tray 31, etc.

Some embodiments of operator station 80 may provide a button to reverse the operation of the operator controls. For example, some cuts into which an operator inserts recovery vehicle 20 may be quite long. Going in, recovery vehicle 20 is moving forward and the operation of recovery vehicle 20 is natural. Returning out of the cut, recovery vehicle 20 will be moving in reverse over an extended distance. This may be tedious or awkward for an operator. By reversing the controls, the operator can drive recovery vehicle 20 as if it is going forward. If necessary, the video displays 84 can be altered as well.

Pedals 83 provide another method of receiving inputs from an operator. Pedals 83 may control speed or braking, etc. Pedals 83 may also relate to operation of a recovery implement, particularly for recovery implements that have more degrees of freedom than scoop 22. Additionally, power equipment frequently have a switch which must be held closed by an operator while the equipment is being operated. Known as a deadman switch, this switch prevents the equipment from operating should the operator cease to hold the switch closed due to some disability, or other reason. Pedals 83 may serve this purpose as well.

Programmable logic controller 91 in operator station 80 receives signals from joystick 82, pedals 83, buttons 85 and other input receivers and converts them for transmission over the Ethernet communication link. Ethernet extender 92 receives these signals from controller 91 and transmits them over data cable 40.

In addition to controlling recovery vehicle 20, in some embodiments of material and equipment recovery system 10, operator station 80 may also control elements of surface control station 60. Outriggers 65 provide leveling and stabilizing functions, and when powered, by hydraulics for example, can be controlled from operator station 80. Crane 77 and winch 74, to the right of operator station 80 in FIG. 3, may also be controlled from operator station 80. Of course, some embodiments may provide that crane 77 can be operated by a person external to operator station 80 and positioned closer to battery station 79.

Although specific embodiments of the invention have been described with specificity, the embodiments described should not be considered exhaustive of the possible embodiments of the invention and should not be held as limiting the scope and range of the claims. Similarly the drawings are not exhaustive depictions of embodiments of the invention and the abstract is intended to allow a person to quickly gain the general field of the invention and should not be taken as limiting the scope of the claims.

I claim:

1. A material and equipment recovery system comprising:
a recovery vehicle comprising;
a chassis having a forward end and a rear end;
a drive train mounted on said chassis;
a retrieval hitch proximal to said rear end;
an operable recovery implement attached to said forward end;
a recovery vehicle controller issuing control signals for said drive train and said operable recovery implement;
a video camera and a light mounted to said chassis proximal to said forward end and directed in the forward direction, a video camera and a light mounted to said chassis proximal to said rear end and directed in the rear direction, and a camera directed at a set of displays of status gauges mounted to said chassis;
a first Ethernet extender issuing said control signals to said recovery vehicle controller and receiving video signals from said video cameras;
a data cable in electrical continuity with said First Ethernet extender and conveying said control signals to said first Ethernet extender and receiving said video signals from said first Ethernet extender;
and a surface control station comprising;
a wheeled chassis;
a second Ethernet extender in electrical continuity with said data cable and issuing said control signals to said data cable and receiving said video signals from said data cable;
an operator station on said wheeled chassis, said operator's station comprising,
a video display screen, said video display screen receiving said video signals from said second Ethernet extender and displaying video images derived from said video signals,
a surface station controller, said surface station controller conveying said control signals to said second Ethernet extender,
an operator interface, said operator interface receiving input from an operator, said operator interface generating said control signals from said input and conveying said control signals to said surface station controller, and
a winch with a retrieval cable, said winch mounted on said wheeled chassis, said retrieval cable being attached to said retrieval hitch on said recovery vehicle.

2. The material and equipment recovery system of claim 1, wherein:
said recovery vehicle is powered by an electrical power supply.

3. The material and equipment recovery system of claim 2, wherein:
said electrical power supply is an onboard power supply.

4. The material and equipment recovery system of claim 3, wherein:
said onboard power supply is an onboard battery pack.

5. The material and equipment recovery system of claim 2, wherein:
said electrical power supply is a power cable.

6. The material and equipment recovery system of claim 1, wherein:
said drive train is a hydraulic drive train.

7. The material and equipment recovery system of claim 1, wherein:
said drive train drives a set of wheels.

8. The material and equipment recovery system of claim 1, wherein:
said operable recovery implement is a scoop.

9. The material and equipment recovery system of claim 1, said set of displays of status gauges comprising:
at least one from the following group;
a methane gauge monitor display,
a power source level display, or
a drive train status gauge display.

10. The material and equipment recovery system of claim 1, further comprising:
a first hitch element mounted on said wheeled chassis of said surface control station; and
a second hitch element mounted on said chassis of said recovery vehicle proximal to said rear end;
said first hitch element and said second hitch element being capable of coupling together; and,
said recovery vehicle capable of repositioning said surface control station.

11. The material and equipment recovery system of claim 1, said surface control station further comprising:
an optical alignment device.

12. The material and equipment recovery system of claim 11, wherein:

said optical alignment device comprises an optical alignment laser.

13. The material and equipment recovery system of claim 1, said recovery vehicle further comprising:

a powered cable reel, said data cable being attached to said cable reel, said cable reel having a slip ring to keep said data cable in electrical continuity with said first Ethernet extender.

14. The material and equipment recovery system of claim 1, said surface control station further comprising:

an electrical generator, said electrical generator providing onboard power for said surface control station.

15. The material and equipment recovery system of claim 14, said surface control station further comprising:

a battery charger.

16. The material and equipment recovery system of claim 15, said surface control station further comprising:

a battery charging station.

17. The material and equipment recovery system of claim 1, said surface control station further comprising:

a crane.

18. A material and equipment recovery system comprising:

a recovery vehicle comprising;

a chassis having a forward end and a rear end;

a drive train mounted on said chassis;

a retrieval hitch proximal to said rear end;

an operable recovery implement attached to said forward end;

a recovery vehicle controller issuing control signals for said drive train and said operable recovery implement;

a video camera and a light mounted to said chassis proximal to said forward end and directed in the forward direction, a video camera and a light mounted to said chassis proximal to said rear end and directed in the rear direction, and a camera directed at a set of displays of status gauges mounted to said chassis;

a surface control station comprising;

a wheeled chassis;

an operator's station on said wheeled chassis, said operator's station comprising, a video display screen, an operator interface, said operator interface receiving input from an operator, said operator interface generating said control signals from said input, a winch with a retrieval cable, said winch mounted on said wheeled chassis, said retrieval cable being attached to said retrieval hitch on said recovery vehicle; and, an Ethernet link between said recovery vehicle and said surface control station, said Ethernet link comprising a first Ethernet extender on said recovery vehicle, a second Ethernet extender on said surface control station, and a data cable providing electrical continuity between said first and second Ethernet extenders, said Ethernet link delivering said control signals from said operator interface to said recovery vehicle and delivering video signals from said cameras to said surface control station to be displayed on said video display screen.

19. The material and equipment recovery system of claim 18, said recovery vehicle further comprising:

a powered cable reel, said data cable being attached to said cable reel, said cable reel having a slip ring to keep said data cable in electrical continuity with said first Ethernet extender.

20. The material and equipment recovery system of claim 18, wherein:

said operable recovery implement is a scoop.

21. The material and equipment recovery system of claim 18, said surface control station further comprising:

an optical alignment device.

22. The material and equipment recovery system of claim 21, wherein:

said optical alignment device comprises an optical alignment laser.

* * * * *